United States Patent [19]

Sasaki et al.

[11] 4,247,929

[45] * Jan. 27, 1981

[54] SWITCHING MECHANISM FOR ELECTRONIC WRISTWATCH

[75] Inventors: Takehiko Sasaki, Yamatokoriyama; Hidetoshi Maeda, Tenri, both of Japan

[73] Assignee: Sharp Kabushiki Kaisha, Osaka, Japan

[ * ] Notice: The portion of the term of this patent subsequent to Nov. 29, 1994, has been disclaimed.

[21] Appl. No.: 783,405

[22] Filed: Mar. 31, 1977

Related U.S. Application Data

[62] Division of Ser. No. 575,731, May 8, 1975, abandoned.

[30] Foreign Application Priority Data

May 8, 1974 [JP] Japan ..... 49-51456
Jul. 4, 1974 [JP] Japan ..... 49-77029

[51] Int. Cl.[3] ..... G04C 17/00

[52] U.S. Cl. ..... 368/69; 200/DIG. 1; 200/DIG. 2; 200/52 R

[58] Field of Search ..... 307/116; 84/DIG. 7; 340/365, 324 A; 200/DIG. 2, DIG. 1, 52 R, ; 58/23 R, 23 BA, 50 R, 85.5, 23 A; 368/69

[56] References Cited

U.S. PATENT DOCUMENTS

| | | | |
|---|---|---|---|
| 2,340,213 | 1/1944 | Ellsworth | 84/DIG. 7 |
| 2,873,637 | 2/1959 | Herold | 84/DIG. 7 |
| 3,081,594 | 3/1963 | Atkins et al. | 58/50 R |
| 3,670,322 | 6/1972 | Mallebrein | 340/324 A |
| 3,823,550 | 7/1974 | Bergey | 58/50 R |
| 3,944,843 | 3/1976 | Martins | 307/116 |
| 4,059,956 | 11/1977 | Maeda et al. | 58/50 R X |

*Primary Examiner*—Ulysses Weldon
*Attorney, Agent, or Firm*—Birch, Stewart, Kolasch & Birch

[57] ABSTRACT

A thin-film transparent electrode is provided on the front glass of an electronic wristwatch to form a part of a switching mechanism cooperation with a metal frame provided at the back of the wristwatch. The metal frame is maintained in contact with the operator's wrist in an operative condition. When the operator touches the thin-film transparent electrode, the switching mechanism in its ON condition provides a signal for controlling an operation mode of the electronic wristwatch, for example, a display condition.

2 Claims, 7 Drawing Figures

SWITCHING MECHANISM FOR ELECTRONIC WRISTWATCH

This is a division of application Ser. No. 575,731 filed May 8, 1975 now abandoned.

BACKGROUND AND SUMMARY OF THE INVENTION

The present invention relates to an electronic wristwatch and more particularly relates to a switch mechanism for an electronic wristwatch for controlling an operation mode of the watch.

The electronic wristwatch usually includes a digital display unit made of, for example, a liquid crystal display unit or light-emitting diodes. The light-emitting diodes consume considerably large power, though it is not preferable for the electronic wristwatch. In order to avoid unnecessary power dissipation on an light-emitting diodes, an effective display system has been proposed wherein the display is enabled only at a desired time by closing a switch of which a knob is provided on a frame of the wristwatch. It was difficult to handle the above-mentioned switch of the prior art, since the knob was very small and the wristwatch can not always be tightly fixed to the operator's wrist. The vacuum-tight construction was complicated because of provision of such switch knob.

Accordingly, an object of the present invention is to provide a novel switch mechanism for an electronic wristwatch for controlling the operation mode of an electronic wristwatch.

Another object of the present invention is to provide a network for detecting a closing of an switch mechanism of the electronic wristwatch. Other objects and further scope of applicability of the present invention will become apparent from the detailed description give hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to the present invention, a thin-film transparent electrode is provided on the front window of an electronic wristwatch through use of the vacuum evaporation technology. A metal frame provided at the back of the wristwatch is kept in contact with the operator's wrist in an operative condition. A complementary metal oxide semiconductor inverter circuit is provided to detect a resistance value between the thin-film transparent electrode and the metal frame. When the operator touches the thin-film transparent electrode, an electric current flow is created through the operator. The reduction of the resistance value is detected by the complementary metal oxide semiconductor inverter circuit, which then provides a signal for controlling an operation mode of the electronic wristwatch, for example, a display condition.

BRIEF DESCRIPTION OF THE DRAWINGS

The present invention will become more fully understood from the detailed description given hereinbelow and the accompanying drawings which are given by way of illustration only, and thus do not limit the present invention and wherein.

DESCRIPTION OF THE PREFERRED EMBODIMENTS

Figure 1:
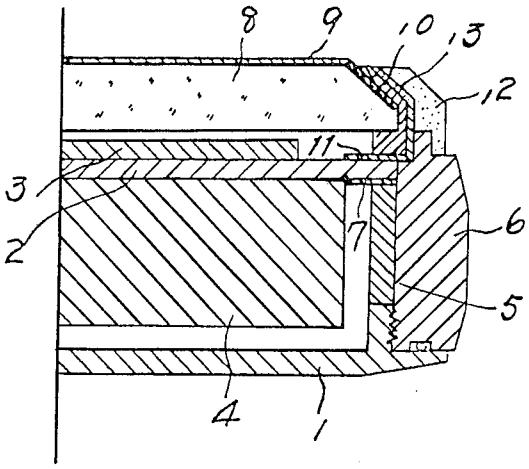
FIG. 1 is a cross-sectional view of an electronic wristwatch of the present invention.

Referring now to FIG. 1, there is illustrated an embodiment of an electronic wristwatch of the present invention, a metal frame 1 is provided at the back of the electronic wristwatch, which is kept in contact with the operator's wrist in its operative condition. The metal frame 1 acts as an electrode for a switching mechanism. A substrate 2 made of ceramics or resin is provided for supporting display elements 3 made of light-emitting diodes on its upper surface and movements 4 necessary for performing the counting operation of the watch on its rear surface. Electrical connection between the metal frame 1 and the movements 4 is achieved through an internal frame 5 made of metal, a casing 6 made of metal and a metal leaf 7 attached to the rear surface of the substrate 2.

A front glass 8 is provided above the display elements 3. The upper surface of the front glass 8 is coated with a thin-film transparent electrode 9 through the use of vacuum evaporation technology, the thin-film transparent electrode 9 acting as another electrode for the switching mechanism. The thin-film transparent electrode 9 is usually made of indium oxide or tin oxide and is tightly attached to the glass 8 and can not be easily peeled off. The thin-film transparent electrode 9 is electrically connected with the movements 4 through a conductive rubber frame 10, which also acts as an water-proof packing, and a metal leaf 11. An insulating rubber frame 13 is provided for electrically insulating the thin-film transparent electrode 9 and the conductive rubber frame 10 from a glass supporter 12 made of metal and the casing 6 made of metal. The conductive rubber frame 10 and the insulating rubber frame 13 can be constructed in a single body, thereby facilitating the fabrication of the electronic wristwatch.

Figure 2:
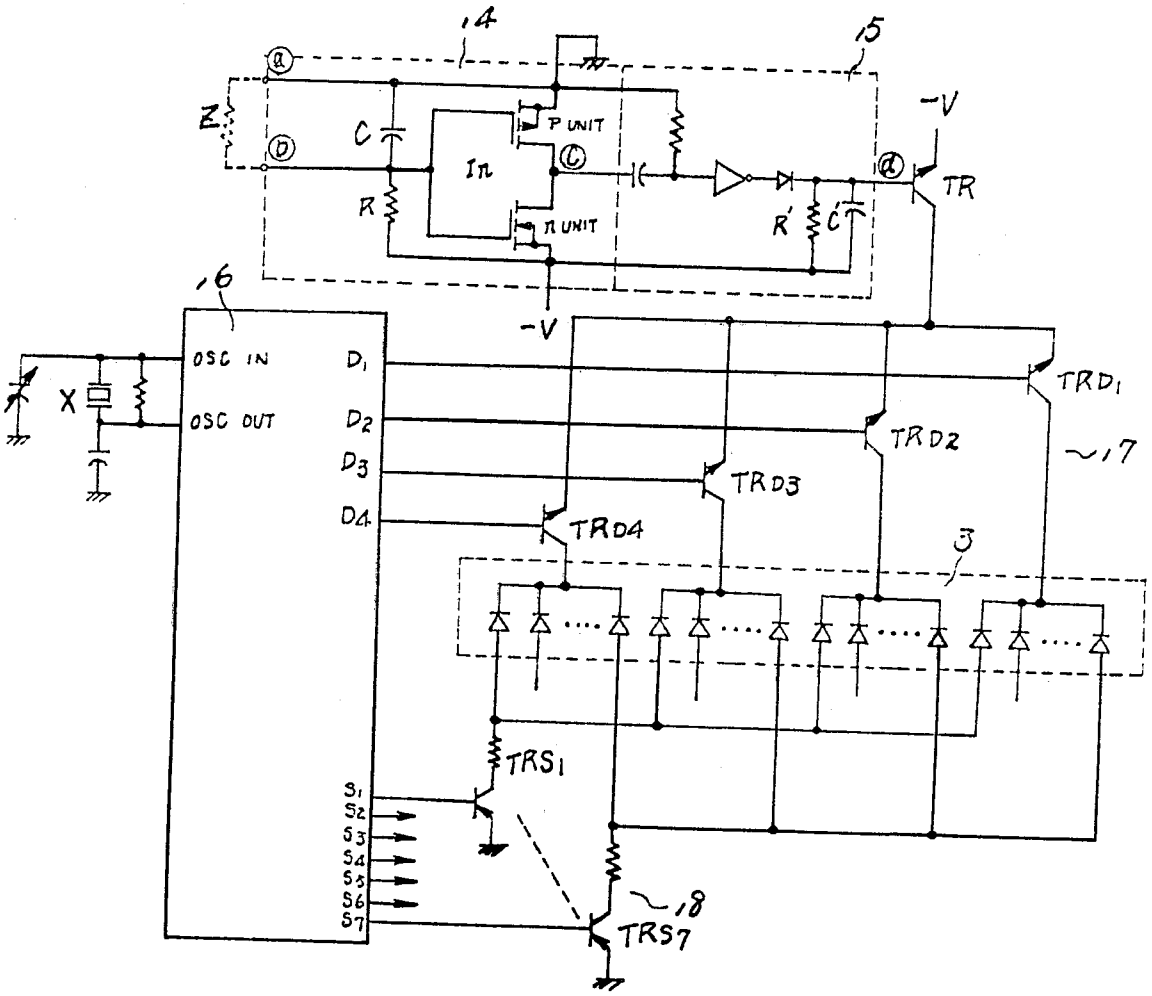
FIG. 2 is a circuit diagram of the electronic wristwatch of the present invention.

FIG. 2 shows a circuit construction of the electronic wristwatch of the present invention including the display elements 3 made of the lightemitting diodes, the movements 4, the metal rear frame 1 and the thinfilm transparent electrode 9.

In FIG. 2 a point ⓐ corresponds to the metal rear frame 1 and a point ⓑ corresponds to the thin film transparent electrode 9, respectively. A switching circuit 14 comprises a C-MOS inverter In which has two input terminals ⓐ and ⓑ associated with the metal rear frame 1 and the thin-film transparent electrode 9, respectively.

When the electric circuit between the points ⓐ and ⓑ is in the open condition, the gate input of the C-MOS inverter In is connected with a negative voltage source −V though a resistor R of high resistance. The gate input can be maintained at a low level (logical value "0") even though the electrical path is shunted through the high resistance R (in principle $R \leqq 10^{12}\Omega$), since the input impedance of the C-MOS inverter In is usually around $10^{12}\Omega$. Accordingly, the gate input of the C-MOS inverter In is usually maintained at the low level (logical value "0") by the high resistance R.

When the operator touches the thin-film transparent electrode 9, the points ⓐ and ⓑ are connected each other through a resistance Z which is caused by the operator's body. The gate input voltage $V_G$ is identical with the voltage value divided by the resistances Z and R, and can be expressed as follows:

$$V_G = -(R/Z+R)V \quad (1)$$

When the gate input voltage $V_G$ exceeds the threshold voltage $V_T$ of the C-MOS inverter In, the gate input changes from its low level (logical value "0") to its high level (logical value "1"). It will be noted that the condition of the inversion is as follows:

$$V_G > V_T \quad (2)$$

The threshold voltage $V_T$ of the C-MOS inverter In unavoidably varies depending upon the individual condition. Now assume that;

$$V_T = -0.7V \quad (3)$$

The following relation can be derived from the expressions (1), (2) and (3).

$$(R/Z-R) > 0.7 \quad (4)$$

or $$R > 2.3Z \quad (5)$$

When the input impedance of the C-MOS inverter In is represented as Zin, the condition of the inversion of the gate input from its high level (logical value "1") to its low level (logical value "0") can be expressed as follows:

$$V_G = -(R/Zin+R)V \quad (6)$$

$$V_T > V_G \quad (7)$$

$$V_T = -0.3V \quad (8)$$

Therefore, the following expression can be derived from the expressions (6), (7) and (8).

$$(R/Zin+R) < 0.3 \quad (9)$$

or $$R < 0.4\ Zin \quad (10)$$

When the resistance value Z of the operator's body is $5 \times 10^6\Omega$, the resistance value R in the expression (5) can be expressed as follows:

$$R > 2.3 \times 5 \times 10^6 = 11.5 \times 10^6 \quad (11)$$

When the input impedance Zin is $10^{12}\Omega$, the resistance value R in the expression (10) can be expressed as follows:

$$R < 4 \times 10^{11} \quad (12)$$

It will be clear from expressions (11) and (12) that the switching mechanism can be performed by the C-MOS inverter In when the resistance value R of the high resistance is selected around $20 \times 10^6\Omega$.

A capacitor C cooperates with the resistor R within the switching circuit 14 to form a low-pass filter, thereby preventing the entrance of the induced noise.

An inverter output from a point ⓒ of the switching circuit 14 is introduced into a mono-stable multivibrator 15. The mono-stable multivibrator 15 is triggered at the trailing edge of the inverter output and the operation period thereof is decided by a time constant determined by a resistor R′ and a capacitor C′. The mono-stable multivibrator 15 provides an output signal at a point ⓓ for the base electrode of a transistor TR which controls a voltage supply for the display elements 3 made of the light-emitting diodes. A main circuit 16 can be of a conventional construction and can be made of, for example, a C-MOS LSI comprising a generation circuit, a divider, a counter and a decoder. An input terminal OSCIN and an output terminal OSCOUT of the generation circuit in the main circuit 16 are connected with the both ends of a quartz-crystal oscillator X, respectively. The generation circuit, the divider, the counter and the decoder can be of conventional constructions and hence the detailed circuit constructions thereof have been omitted from this description for the purpose of simplicity. Digit selection terminals $D_1$–$D_4$ and segment selection terminals $S_1$–$S_7$ of the main circuit 16 are connected with respective driver circuits 17 and 18. The driver circuit 17 comprises transistors $TRD_1$–$TRD_4$ of which the base electrodes are connected to receive the respective output signals from the digit selection terminals $D_1$–$D_4$. The driver circuit 18 comprises transistors $TRS_1$–$TRS_7$ of which the base electrodes are connected with the segment selection terminals $S_1$–$S_7$, respectively. The driver circuits 17 and 18 can be incorporated into the LSI comprising the main circuit 16. Moreover, the LSI also can incorporate the switching circuit 14 and the mono-stable multivibrator 15 therein.

Figure 3:
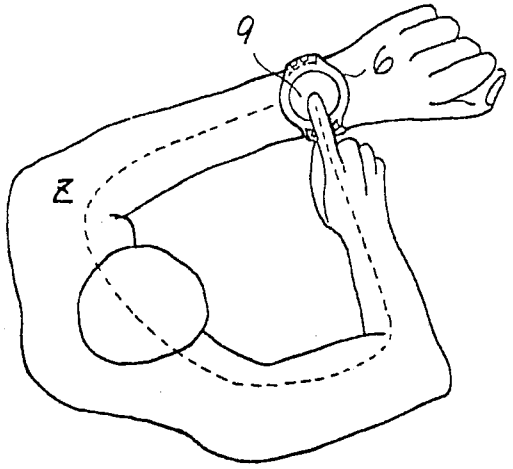
FIG. 3 is a schematic view for the purpose of explanation of the operation mode of the electronic wristwatch of the present invention.

FIG. 3 shows an operation mode of the electronic wristwatch when the operator touches the thin-film transparent electrode 9 provided on the front glass of the electronic wristwatch which is fixed to the operator's wrist. The electric current flow is created through the operator's body as shown by dotted lines in FIG. 3. The resistor Z is connected between the points ⓐ and ⓑ in the circuit of FIG. 2 when the operator touches the thin-film transparent electrode 9. The resistance value of the resistor Z is about $5 \times 10^6\Omega$ at its maximum, whereas the resistor R in the switching circuit 14 is selected at $20 \times 10^6\Omega$.

Figure 4:
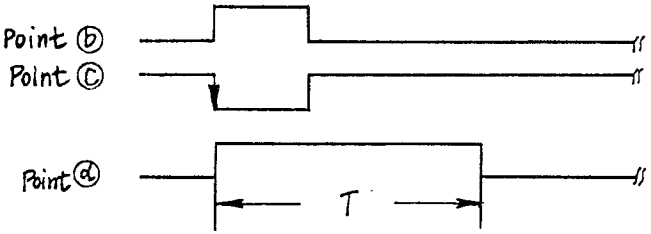
FIGS. 4 and 5 are time charts showing waveforms occurring within the circuit of FIG. 2.

When the resistance Z caused by the operator's body is inserted between the points ⓐ and ⓑ, the gate input of the inverter In changes from its low level (logical value "0") to its high level (logical value "1") as shown in a time chart of FIG. 4, point ⓑ. The inversion of the gate input of the inverter In can be referred to as a display indication signal. The display indication signal changes the inverter output from its high level (logical value "1") to its low level (logical value "0") as shown in FIG. 4 point ⓒ. The trailing edge of the signal at the point ⓒ, which is inverted from its high level to its low level upon receiving the display indication signal, triggers the mono-stable multivibrator 15. The output signal at the point ⓓ of the mono-stable multivibrator 15 is inverted from its low level (logical value "0") to its high level (logical value "1"), and then the high level is maintained during a predetermined time period T decided by the time constant determined by the resistor R′ and the capacitor C′ as shown in FIG. 4 point ⓓ.

When the point ⓓ is at the high level, the transistor TR is ON and hence the display elements 3 made of the light-emitting diodes are supplied with the negative power voltage −V via the transistors $TRD_1$–$TRD_4$ and $TRS_1$–$TRS_7$, which are controlled by the output signals from the digit selection terminals $D_1$–$D_4$ and the segment selection terminals $S_1$–$S_7$ of the main circuit 16, whereby the information corresponding to the current time is displayed on the display elements 3. The display is maintained during the time period T determined by the resistor R′ and the capacitor C′, thereby securing an accurate reading.

When the points ⓐ and ⓑ are erroneously shunted for a long period through a material except the operator's body, the unnecessary power dissipation on the display elements 3 can be avoided in a following manner.

Figure 5:
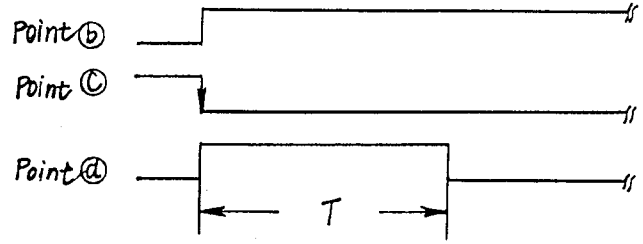

Even when the point ⓑ is maintained at the high level for a long period upon shunting the points ⓐ and ⓑ as shown in a time chart of FIG. 5 point ⓑ, the trailing edge of the signal at the point ⓒ appears only once as shown in FIG. 5 point ⓒ. Therefore, the following mono-stable multivibrator 15 is triggered only once. The output signal at the point ⓓ is maintained at its high level during the predetermined time period T as shown in FIG. 5 point ⓓ. The display elements 3 are enabled only during the predetermined time period T, and therefore, the unnecessary power dissipation on the display elements 3 is avoided.

The mon-stable multivibrator 15 can be avoided when the display can be easily read by the operator without being disturbed by the operator's hand which touches the thin-film transparent electrode 9. In this case the display is carried out during the time period when the operator touches the thin-film transparent electrode 9. The mono-stable multivibrator 15 can be alternatively be constructed to be triggered at the leading edge of the signal at the point ⓒ, whereby the display is carried out during a predetermined time period after the operator removes his hand from the thin-film transparent electrode 9.

In the foregoing embodiment the switching mechanism controls the power supply for the display elements made of the light-emitting diodes. When the display unit is made of the liquid-crystal display unit, the present switching mechanism can be applied to control a lamp for irradiating the liquid-crystal display unit at night in order to facilitate the reading operation. The present switching mechanism can also be applied to control the changing of the display information between, for example, hours and minutes, and dates.

Figure 6:
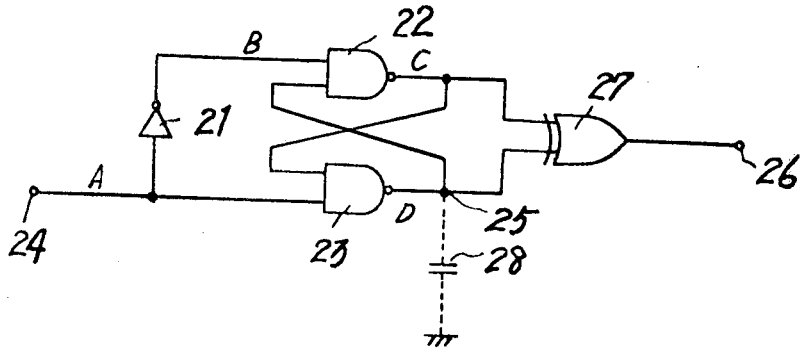
FIG. 6 is a circuit diagram of another embodiment of a switching circuit of the present invention.

FIG. 6 shows another embodiment of the switching circuit 14. The switching circuit of this embodiment comprises an inverter 21, an RS-flip-flop including NAND gates 22 and 23, and a C-MOS exclusive OR gate 27.

Figure 7:
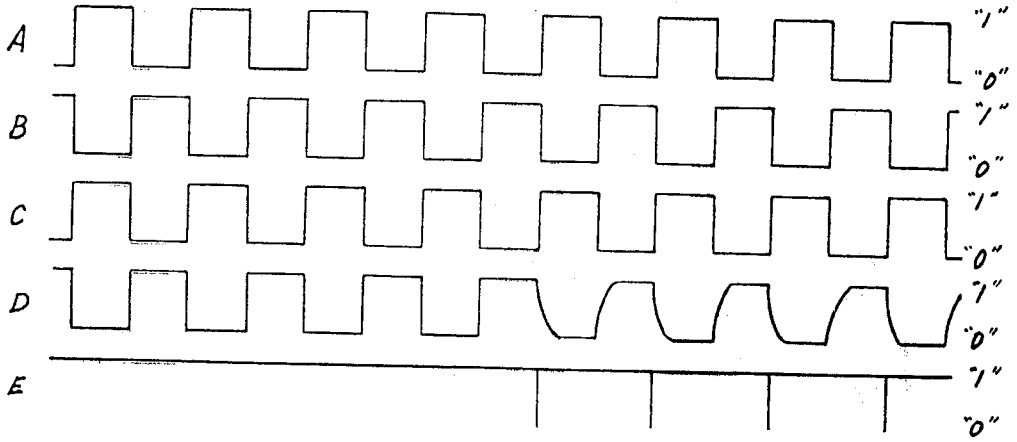
FIG. 7 is a time chart for the purpose of explanation of the switching circuit of FIG. 6.

The operation mode of the switching circuit of FIG. 6 will be described with reference to FIG. 7 time chart. An input terminal 24 is connected to receive a signal A from the main circuit 16. The signal A is inverted to provide a signal B by the inverter 21 and then applied to the NAND gate 22. The NAND gates 22 and 23 provide signals C and D, which are applied to the exclusive OR gate 27 providing an output signal E to be applied to the mono-stable multivibrator 15. An output terminal 25 of the NAND gate 23 is connected with the thin-film transparent electrode 9. When the operator touches the thin-film transparent electrode 9, a capacitor 28 of considerably large capacitance is connected between the output terminal 25 and the ground potential. The signal D at the point 23 is delayed by the capacitor 28 as shown in FIG. 7D and hence the exclusive OR gate 27 provides a pulse signal shown in FIG. 7E at its output terminal 26. The first appearing pulse signal at the output terminal 26 triggers the following mono-stable multivibrator 15.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A touch-sensitive electronic switching system for an electronic wristwatch comprising:

a conductive rear cover on said electronic wristwatch normally engaged with the body skin of a wearer;

a front casing for said electronic wristwatch which is selectively engageable by the wearer with the hand of the wearer opposite to that on which the electronic wristwatch is being worn;

an electrode formed on said front casing of said electronic wristwatch;

insulating means for electrically isolating said electrode from said conductive rear cover; and electronic switching means including first and second terminals connected to said electrode and said conductive rear cover, respectively, said electronic switching means being actuated in response to interconnection of said first and second terminals through the resistance of the body of the wearer upon engagement of said electrode by said opposite hand of said wearer.

2. The touch sensitive switching system according to claim 1 wherein said electrode formed on said front casing is transparent.

* * * * *